US006634913B2

(12) United States Patent
Shibata et al.

(10) Patent No.: US 6,634,913 B2
(45) Date of Patent: Oct. 21, 2003

(54) COOLING ARRANGEMENT FOR OUTBOARD MOTOR

(75) Inventors: Yasuhiko Shibata, Shizuoka (JP); Takaji Kawai, Shizuoka (JP); Koichi Isozaki, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/171,058

(22) Filed: Jun. 11, 2002

(65) Prior Publication Data

US 2002/0193022 A1 Dec. 19, 2002

(30) Foreign Application Priority Data

Jun. 19, 2001 (JP) ..... 2001-184926

(51) Int. Cl.[7] ..... B63H 21/32

(52) U.S. Cl. ..... 440/88 C; 440/88 G; 440/89 B

(58) Field of Search ..... 440/88 R, 88 L, 440/88 G, 88 C, 89 R, 89 B, 89 C

(56) References Cited

U.S. PATENT DOCUMENTS

| | | | | |
|---|---|---|---|---|
| 3,310,022 A | | 3/1967 | Kollman | |
| 3,350,879 A | | 11/1967 | Boda et al. | |
| 4,421,490 A | | 12/1983 | Nakahama | |
| 4,523,556 A | | 6/1985 | Suzuki | |
| 5,036,804 A | | 8/1991 | Shibata | |
| 5,118,316 A | | 6/1992 | Kakizaki et al. | |
| 5,232,387 A | | 8/1993 | Sumigawa | |
| 5,439,404 A | * | 8/1995 | Sumigawa | 440/88 L |
| 5,487,688 A | | 1/1996 | Sumigawa | |
| 5,595,515 A | | 1/1997 | Hasegawa et al. | |
| 5,733,157 A | | 3/1998 | Okuzawa et al. | |
| 5,769,038 A | | 6/1998 | Takahashi et al. | |

(List continued on next page.)

OTHER PUBLICATIONS

Co–pending patent application: Ser. No. 09/303,066, filed Apr. 30, 1999, entitled Exhaust Arrangement for Outboard Motor, in the name of Tsunekawa et al., and assigned to Sanshin Kogyo Kabushiki Kaisha.

Co–pending patent application: Ser. No. 09/440,777, filed Nov. 16,1999, entitled Outboard Motor Cooling System, in the name of Toshihiro Nozue, and assigned to Sanshin Kogyo Kabushiki Kaisha.

Co–pending patent application: Ser. No. 10/106,525, filed Mar. 25, 2002, entitled Cooling Arrangement for Outboard Motor, in the name of Shibata et al., and assigned to Sanshin Kogyo Kabushiki Kaisha.

*Primary Examiner*—Stephen Avila
(74) *Attorney, Agent, or Firm*—Knobbe, Martens, Olson & Bear LLP

(57) ABSTRACT

An outboard motor includes a housing unit and an engine. The engine defines a first exhaust passage and a first lubricant passage. The first exhaust passage generally extends on a first side of the outboard motor. The first lubricant passage generally extends on a second side of the outboard motor opposite to the first side. An exhaust guide member is coupled with the housing unit to support the engine above the housing unit. An exhaust conduit depends from the exhaust guide member within the housing unit. The exhaust guide member defines a second exhaust passage connecting the exhaust conduit with the first exhaust passage. The second exhaust passage generally extends on the first side. A lubricant reservoir depends from the exhaust guide member within the housing unit. The exhaust guide member defines a second lubricant passage connecting the lubricant reservoir with the first lubricant passage. The second lubricant passage generally extends on the second side. The engine and the exhaust guide member together define a first water passage extending in the vicinity of the first and second exhaust passages. The engine defines a second coolant passage extending from the first coolant passage toward a location in the vicinity of the first lubricant passage.

25 Claims, 13 Drawing Sheets

U.S. PATENT DOCUMENTS 5,816,208 A 10/1998 Kimura
5,924,901 A 7/1999 Takahashi et al.
5,934,960 A 8/1999 Katayama et al.
6,027,385 A 2/2000 Katayama et al.
6,083,064 A * 7/2000 Watanabe et al. ..... 440/88 R
2001/0044245 A1 11/2001 Nakata et al.
2002/0002019 A1 1/2002 Nakata et al.

* cited by examiner

COOLING ARRANGEMENT FOR OUTBOARD MOTOR

PRIORITY INFORMATION

This application is based on and claims priority to Japanese Patent Application No. 2001-184926, filed Jun. 19, 2001, the entire contents of which is hereby expressly incorporated by reference.

BACKGROUND OF THE INVENTION

1. Field of the Invention

This invention relates generally to a cooling arrangement for an outboard motor, and more particularly to an improved cooling arrangement for delivering coolant to multiple locations of an outboard motor.

2. Description of Related Art

An outboard motor typically includes a housing unit that can be mounted on an associated watercraft and an internal combustion engine disposed above the housing unit. The housing unit carries a propulsion device such as, for example, a propeller to propel the watercraft. The engine powers the propulsion device with a driveshaft and a propulsion shaft extending through the housing unit.

Typically, an exhaust system is provided to route the exhaust gases from the engine to a location out of the outboard motor through the housing unit. The engine and the exhaust system build heat because air/fuel charges burn in combustion chamber(s) and then the burnt charges, i.e., exhaust gases, pass through the exhaust system. Typically, the outboard motor has a cooling water delivery system to deliver water taken from a body of water surrounding the outboard motor to the engine and the exhaust system for cooling purposes.

The cooling water delivery system can be arranged adjacent to the exhaust system upstream of the engine. Because an exhaust manifold and an exhaust passage connected to the manifold normally are disposed offset on one side of the outboard motor, a water passage or jacket inevitably is disposed on the same side. Accordingly, another side of the outboard motor tends to become hot and occasionally is damaged thereby. For example, an outer surface of the housing unit on the side spaced apart from the water passage can become discolored.

In addition, an outboard motor employing a four-cycle engine typically includes a lubricant reservoir disposed below the engine within the housing unit. The lubricant reservoir accumulates lubricant oil that has circulated in the engine for lubrication of engine portions. The lubricant reservoir thus can build heat therein also. Because the lubricant in the reservoir is recycled, the heat should be removed before the oil is recirculated through the engine. In some arrangements, the heat of the lubricant reservoir can also expedite the discoloring phenomenon noted above.

SUMMARY OF THE INVENTION

A need therefore exists for an improved cooling arrangement for an outboard motor that can sufficiently cool both sides thereof even if a coolant delivery system is disposed offset on one side.

In accordance with one aspect of the present invention, an outboard motor comprises a housing unit adapted to be mounted on an associated watercraft. An internal combustion engine defines a first exhaust passage and a first lubricant passage. The first exhaust passage generally extends on a first side of the outboard motor. The first lubricant passage generally extends on a second side of the outboard motor opposite to the first side. A support member is coupled with the housing unit to support the engine above the housing unit. An exhaust conduit depends from the support member within the housing unit. The support member defines a second exhaust passage connecting the exhaust conduit with the first exhaust passage. The second exhaust passage generally extends on the first side. A lubricant reservoir depends from the support member within the housing unit. The support member defines a second lubricant passage connecting the lubricant reservoir with the first lubricant passage. The second lubricant passage generally extends on the second side. The engine and the support member together define a first coolant passage extending in the vicinity of the first and second exhaust passages. Either the engine or the support member defines a second coolant passage extending from the first coolant passage toward a location in the vicinity of either the first or second lubricant passage.

In accordance with another aspect of the present invention, an outboard motor comprises a bracket assembly adapted to be mounted on an associated watercraft. A drive unit is supported by the bracket assembly for tilt movement about a generally horizontally extending tilt axis and for steering movement about a generally vertically extending steering axis. The drive unit comprises an internal combustion engine disposed atop thereof. An exhaust system is arranged to discharge exhaust gases from the engine. The exhaust system at least in part is generally disposed on a first side of the drive unit. A coolant delivery system is arranged to cool either the engine or the exhaust system. The coolant delivery system at least in part is generally disposed on the first side of the drive unit. The coolant delivery system includes a coolant passage extending toward a second side of the drive unit opposite to the first side. The coolant passage extends generally horizontally and parallel to the tilt axis.

In accordance with a further aspect of the present invention, an outboard motor comprises a bracket assembly adapted to be mounted on an associated watercraft. A drive unit is supported by the bracket assembly. The drive unit comprises an internal combustion engine disposed atop thereof The engine includes at least one cylinder having a generally horizontally extending axis. An exhaust system is arranged to discharge exhaust gases from the engine. The exhaust system at least in part is generally disposed on a first side of the drive unit. A coolant delivery system is arranged to cool either the engine or the exhaust system. The coolant delivery system at least in part is generally disposed on the first side of the drive unit. The coolant delivery system includes a coolant passage extending to a second side of the drive unit opposite to the first side. The coolant passage extends generally horizontally and normal to the axis of the cylinder.

BRIEF DESCRIPTION OF THE DRAWINGS

These and other features, aspects and advantages of the present invention will now be described with reference to the drawings of a preferred embodiment, which is intended to illustrate and not to limit the invention. The drawings comprise 13 figures.

DETAILED DESCRIPTION OF THE PREFERRED EMBODIMENT OF THE INVENTION

Figure 1:
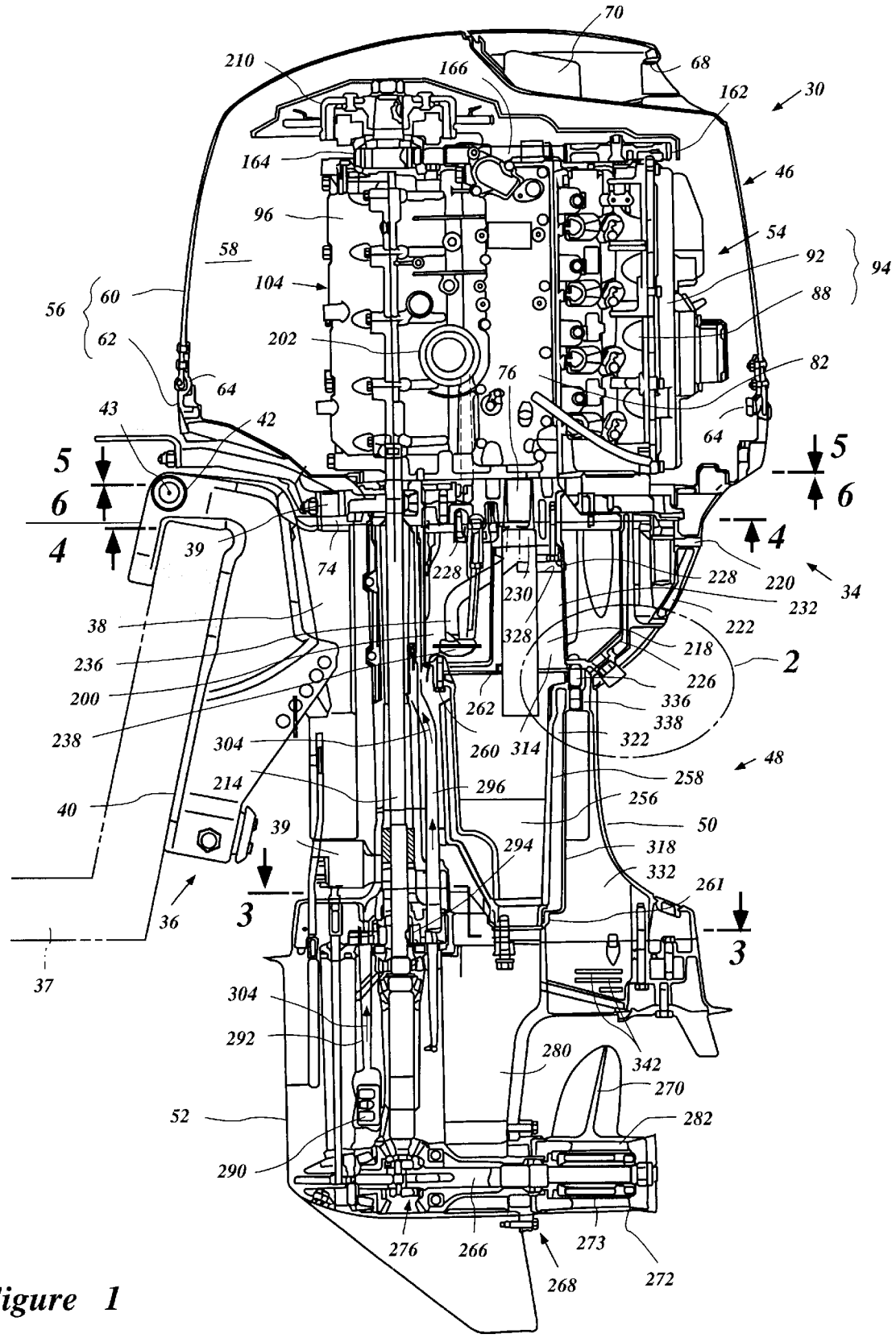
FIG. 1 is a side elevational and partial sectional view of an outboard motor configured in accordance with a preferred embodiment of the present invention. An associated watercraft is shown in phantom.

With particular reference to FIG. 1, an overall construction of an outboard motor 30 configured in accordance with certain features, aspects and advantages of the present invention will be described.

In the illustrated arrangement, the outboard motor 30 comprises a drive unit 34 and a bracket assembly 36. The bracket assembly 36 supports the drive unit 34 on a transom of an associated watercraft 37 and places a marine propulsion device in a submerged position with the watercraft 37 resting on the surface of a body of water. The bracket assembly 36 preferably comprises a swivel bracket 38, a clamping bracket 40, a steering shaft and a pivot pin 42.

The steering shaft typically extends through the swivel bracket 38 and is affixed to the drive unit 34 with upper and lower mount assemblies 39. The steering shaft is pivotally journaled for steering movement about a generally vertically extending steering axis defined within the swivel bracket 38. The clamping bracket 40 comprises a pair of bracket arms that are spaced apart from each other and that are affixed to the watercraft transom. The pivot pin 42 completes a hinge coupling between the swivel bracket 38 and the clamping bracket 40. The pivot pin 42 extends through the bracket arms so that the clamping bracket 40 supports the swivel bracket 38 for pivotal movement about a generally horizontally extending tilt axis 43 defined by the pivot pin 42. The drive unit 34 thus can be tilted or trimmed about the tilt axis 43.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably is provided between the swivel bracket 38 and the clamping bracket 40 to tilt (raise or lower) the swivel bracket 38 and the drive unit 34 relative to the clamping bracket 40. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 46 and a housing unit 48 which includes a driveshaft housing 50 and a lower unit 52. The power head 46 is disposed atop the drive unit 34 and houses an internal combustion engine 54 that is positioned within a protective cowling 56. Preferably, the protective cowling 56 defines a generally closed cavity 58 in which the engine 54 is disposed. The protective cowling 56 preferably comprises a top cowling member 60 and a bottom cowling member 62. The top cowling member 60 preferably is detachably affixed to the bottom cowling member 62 by a coupling mechanism 64 so that a user, operator, mechanic or repairperson can access the engine 54 for maintenance or for other purposes.

The top cowling member 60 preferably defines at least one air intake opening 68 and at least one air duct 70 disposed on its rear and top portion. Ambient air is drawn into the closed cavity 58 through the opening 68 and then through the duct 70. Typically, the top cowling member 60 tapers in girth toward its top surface, which is in the general proximity of the air intake opening 68.

The bottom cowling member 62 preferably has an opening at its bottom portion through which an upper portion of an exhaust guide member or support member 74 extends. The exhaust guide member 74 preferably is made of an aluminum based alloy and is affixed atop the driveshaft housing 50. In other words, the exhaust guide member 74 is mounted on the driveshaft housing 50.

The bottom cowling member 62 and the exhaust guide member 74 together generally form a tray. The engine 54 is placed onto this tray and is affixed to the exhaust guide member 74. In other words, the exhaust guide member 74 supports the engine 54. The exhaust guide member 74 also defines an exhaust passage 76 through which burnt charges (e.g., exhaust gases) from the engine 54 are discharged as described below.

With continuing reference to FIG. 1 and with additional reference to FIGS. 6–13, the engine 54 and the engine 54 in the illustrated embodiment operates on a four-cycle combustion principle. More specifically, the presently preferred engine 54 is a single over-head cam (SOHC), four cylinder, and in-line engine.

The engine 54 has a cylinder block 82. The presently preferred cylinder block 82 defines four cylinder bores 84 which extend generally horizontally and are generally vertically spaced from one another. A center plane CP extending vertically fore to aft of the engine 54 and including respective cylinder bore axes 85 (FIG. 7) generally divides the engine 54 into two part, one part being on the port side while the other part on the starboard side. In the illustrated arrangement, the center plane CP approximately is coincident with a center plane of the outboard motor 30. This type of engine, however, merely exemplifies one type of engine. Engines having other numbers of cylinders, having other cylinder arrangements (V-configuration or opposing), and operating on other combustion principles (e.g., crankcase compression two-stroke or rotary) also can be employed. In addition, the engine can be formed with separate cylinder bores rather than a number of cylinder bores formed in a cylinder block. Regardless of the particular construction, the engine preferably comprises an engine body that includes at least one cylinder bore.

As used in this description, the term "horizontally" means that the subject portions, members or components extend generally in parallel to the water line where the associated watercraft 37 is resting when the drive unit 34 is not tilted and is placed in the position shown in FIG. 1. The term "vertically" in turn means that portions, members or components extend generally normal to those that extend horizontally.

A moveable member, such as a reciprocating piston, moves relative to the cylinder block 82 in a suitable manner. In the illustrated arrangement, a piston 86 reciprocates within each cylinder bore 84. A cylinder head member 88 is affixed to one end of the cylinder block 82. The cylinder head member 88 together with the associated pistons 86 and cylinder bores 84, preferably define four combustion chambers 90. Of course, the number of combustion chambers can vary as described above. The cylinder head member 88 is covered with a cylinder head cover member 92. The cylinder head member 88 and the cylinder head cover member 92 together define a cylinder head assembly 94.

A crankcase member 96 is coupled with the cylinder block 82 to close the other end of the cylinder bores 84 and, together with the cylinder block 82, define a crankcase chamber 98. A crankshaft 100 extends generally vertically through the crankcase chamber 98 and can be journaled for rotation about a rotational axis by several bearing blocks. Connecting rods 102 couple the crankshaft 100 with the respective pistons 86 in a suitable manner so that the reciprocal movement of the pistons 86 rotates the crankshaft 100.

Preferably, the crankcase member 96 is located at the forward-most position of the engine 54 with the cylinder block 82, the cylinder head member 88 and the cylinder head cover member 92 being disposed rearward from the crankcase member 96 one after another. In the illustrated arrangement, the cylinder block 82, the cylinder head member 88, the cylinder head cover member 92 and the crankcase member 96 together define an engine body 104.

Figure 8:
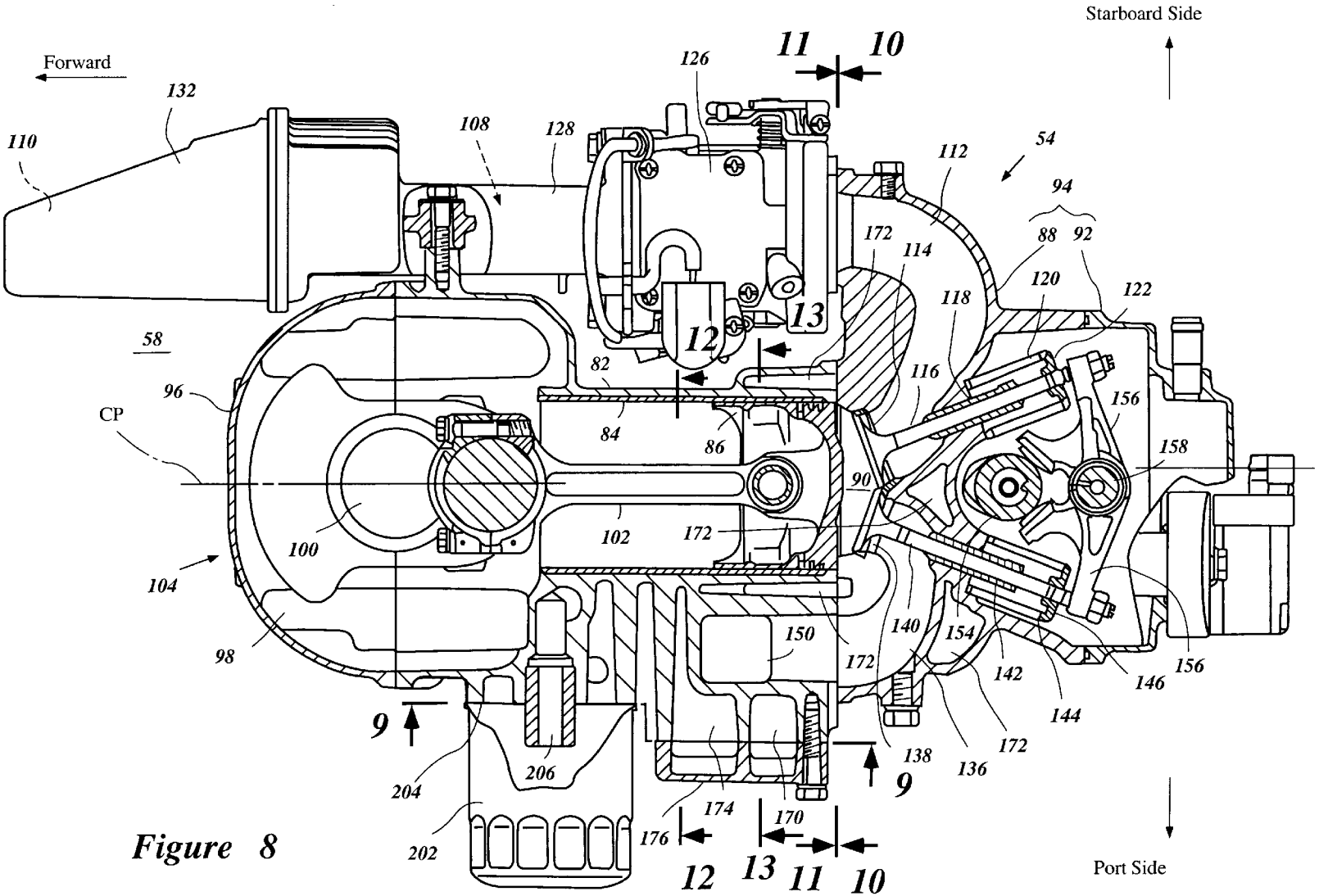
FIG. 8 is a spartial ectional and top plan view of the engine.

With particular reference to FIG. 8, the engine 54 also comprises an air intake system. The air intake system draws air from within the cavity 58 of the cowling assembly 56 to the combustion chambers 90.

The air intake system preferably comprises four intake passages 108 and a single plenum chamber 110. The most-downstream portions of the intake passages 108 are defined within the cylinder head member 88 as a set of inner intake passages 112.

The inner intake passages 112 communicate with the combustion chambers 90 through intake ports 114. Typically, each combustion chamber 90 has one or more intake ports 114. In this arrangement, each combustion chamber 90 has one intake port 114. Intake valves 116 are slideably supported by valve guides 118 disposed at each cylinder head member 88 to move between an open position and a closed position of the intake ports 114. Valve springs 120, which preferably are coil compression springs, urge the intake valves 116 toward the respective closed positions by acting between mounting bosses formed on the cylinder head member 88 and corresponding retainers 122. When each intake valve 116 is in the open position, the inner intake passage 112 associated with the intake port 114 communicates with the associated combustion chamber 90.

Outer portions of the intake passages 108, which are disposed outside of the cylinder head member 88, preferably are defined with four carburetors 126 and four runners 128. Each intake assembly, which comprises the carburetor 126 and the runner 128, extends generally horizontally and forwardly from the cylinder head member 88 along a side surface of the engine body 104 on the starboard side of the outboard motor 30. The respective intake assemblies lie generally parallel to each other and are vertically spaced apart from one another.

Each carburetor 126 includes a throttle valve such as, for example, a butterfly type or a needle type. Valve shafts of the throttle valves are linked together and are connected to a control linkage. The operator can control the opening degree of the throttle valves by operating a control linkage. The throttle valves can meter or regulate amounts of air that are supplied to the combustion chambers 90. Normally, the greater the opening degree, the higher the rate of airflow and the higher the power output of the engine. Simultaneously, proper amounts of fuel corresponding to the air amounts are supplied to the intake passages 108 in order to achieve an optimum air/fuel ratio. Of course, a conventional direct or indirect fuel injection system or other charge forming devices can replace the carburetors 126.

The plenum chamber 110 is defined by a plenum chamber unit 132. The plenum chamber unit 132 has an inlet (not shown) through which air from the cavity 58 is drawn into the plenum chamber 110. The plenum chamber 110 reduces pulsations of intake air and thus attenuates intake noise.

The engine 54 preferably comprises an exhaust system that routes burnt charges, i.e., exhaust gases, to a location outside of the outboard motor. The exhaust system is generally located on the opposite side of the intake system relative to the center plane CP, i.e., on the port side.

The cylinder head member 88 defines a set of inner exhaust passages 136 that communicate with the combustion chambers 90 through one or more exhaust ports 138. In this arrangement, each combustion chamber has one exhaust port 138. Like the intake valves 116, exhaust valves 140 are slideably supported by valve guides 142 disposed at each cylinder head member 88 to move between an open position and a closed position of the exhaust ports 138. Valve springs 144 urge the exhaust valves 140 toward the respective closed positions by acting between mounting bosses formed on the cylinder head member 88 and corresponding retainers 146. When each exhaust valve 140 is in the open position, the inner exhaust passage 136 associated with the exhaust port 138 communicates with the associated combustion chamber 90.

Figure 4:
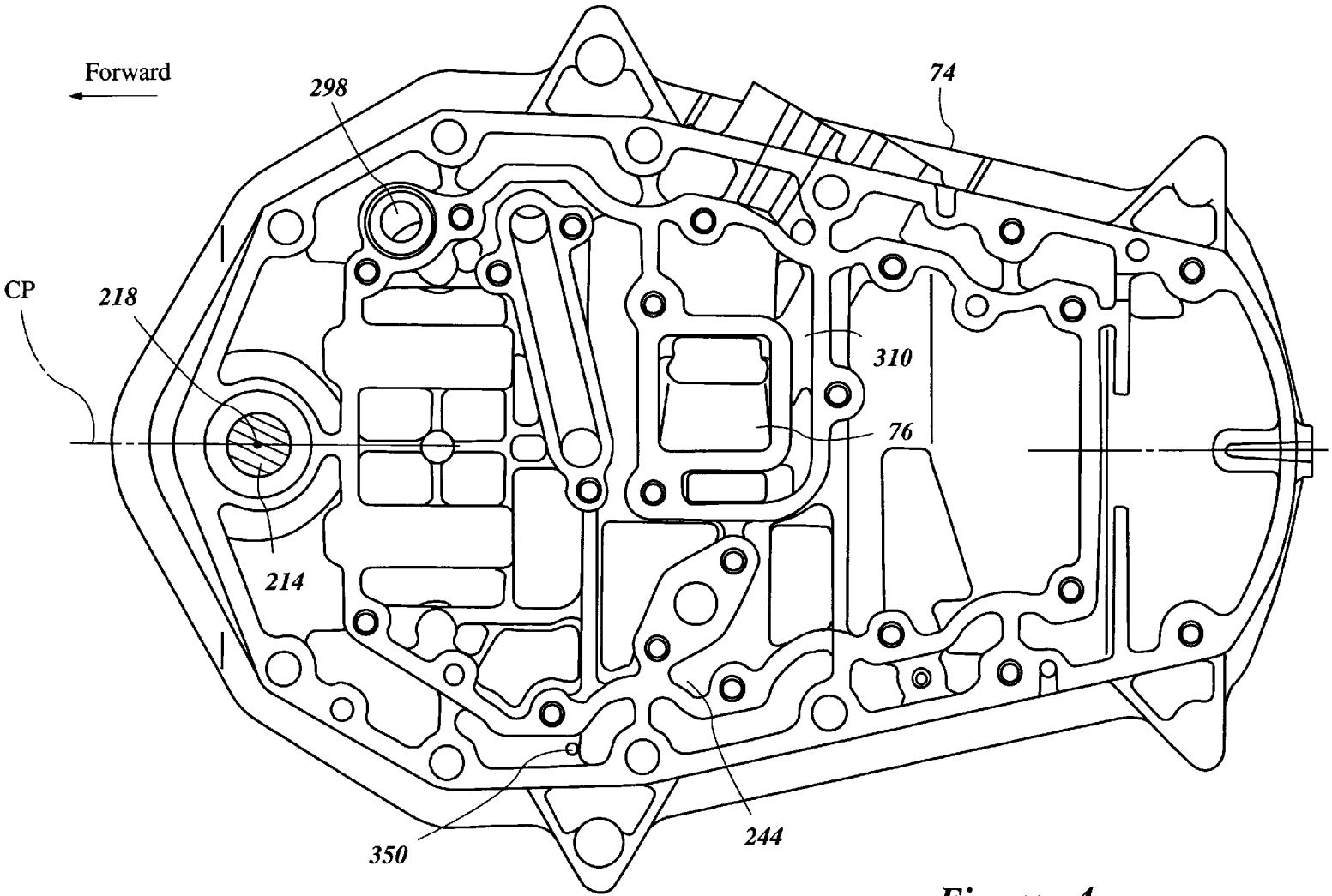
FIG. 4 is a sectional view of the outboard motor taken along the line 4—4 of FIG. 1 showing a bottom plan view of an exhaust guide member therein.
Figure 5:
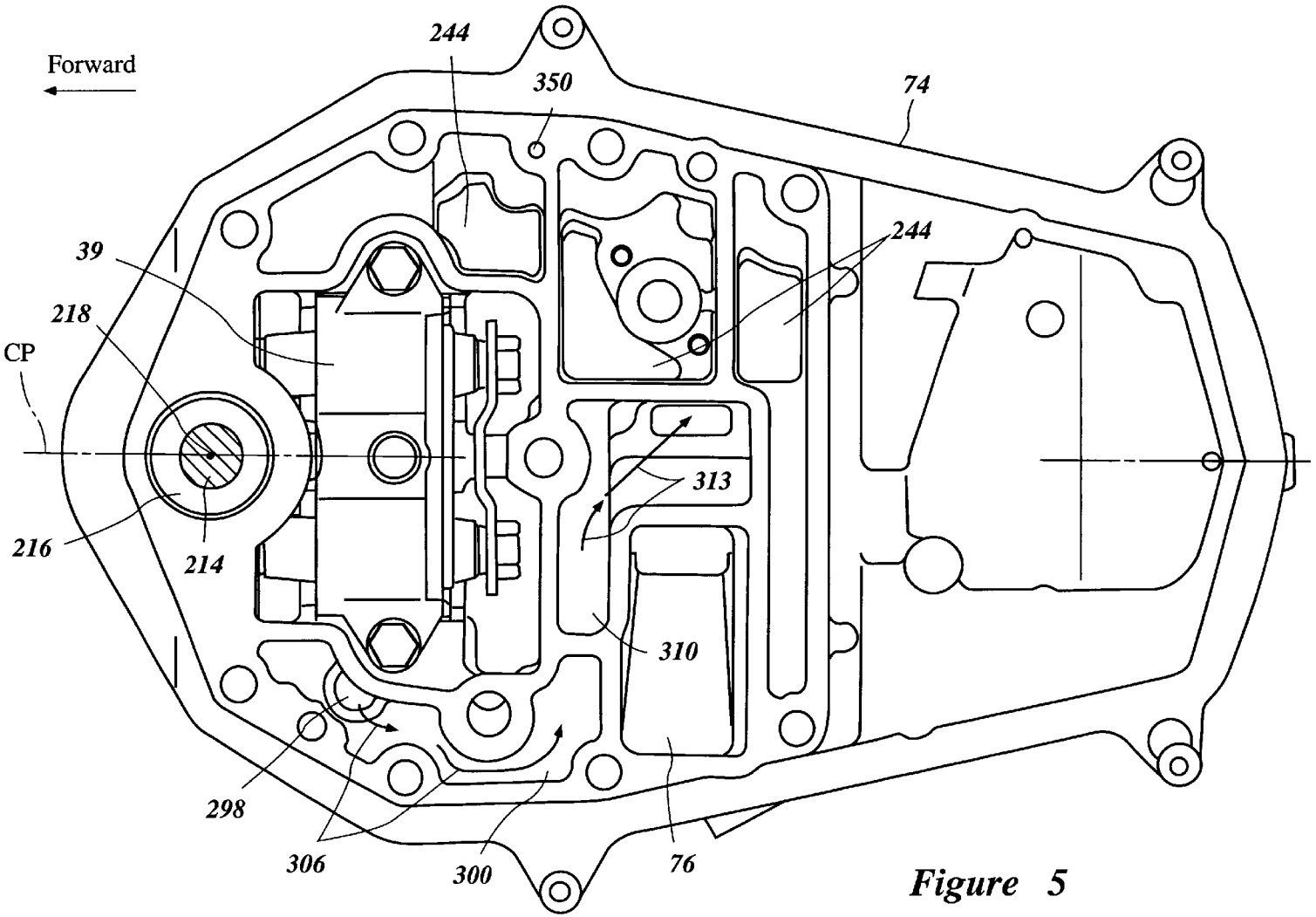
FIG. 5 is sectional view of the outboard motor taken along the line 5—5 of FIG. 1 showing a top plan view of the exhaust guide member of FIG. 4.
Figure 6:
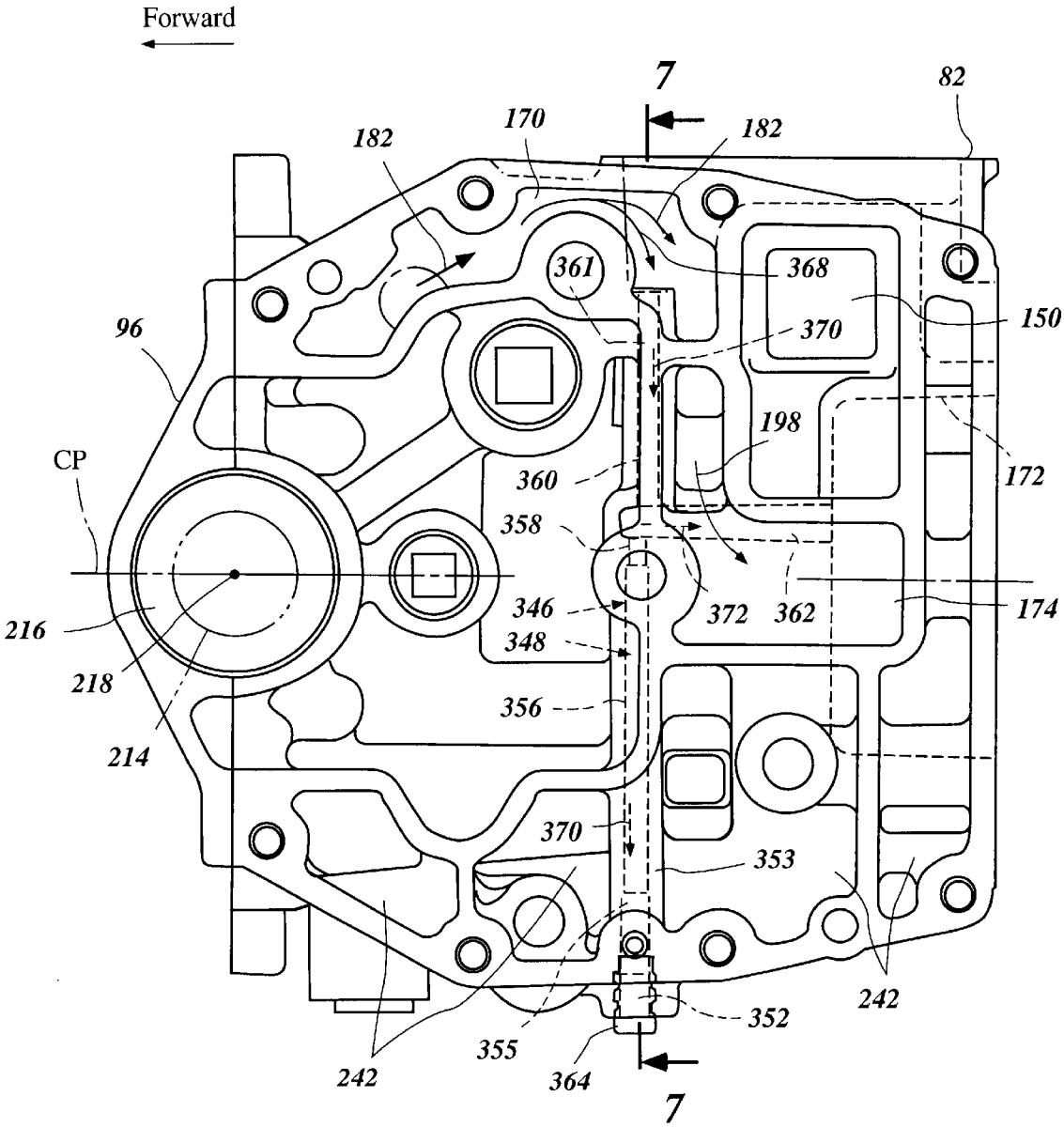
FIG. 6 is a sectional view of the outboard motor taken along the line 6—6 of FIG. 1 showing a bottom plan view of an engine of the outboard motor. A cylinder head assembly of the engine is removed in the figure.

An exhaust manifold 150 preferably is defined within the cylinder block 82 to extend generally vertically on the port side of the outboard motor 30. That is, as shown in FIG. 6, the exhaust manifold 150 is offset from the center plane CP toward the side surface on the port side. Because the illustrated manifold 150 is slightly spaced from the inner exhaust passages 136, the cylinder block 82 defines contiguous portions of the inner exhaust passages 136. The exhaust manifold 150 communicates with the combustion chambers 90 through the inner exhaust passages 136 and the exhaust ports 138 to collect exhaust gases therefrom. The exhaust manifold 150 is coupled with the exhaust passage 76 of the exhaust guide member 74. With particular reference to FIGS. 4 and 5, the exhaust passage 76 of the exhaust guide member 74 is offset from the center plane CP toward the side surface of the exhaust guide member 74 on the port side.

With reference to FIG. 8, a valve drive mechanism is provided for driving the intake and exhaust valves 116, 140. The illustrated valve drive mechanism comprises a single camshaft 154 and eight rocker arms 156. The camshaft 154 extends generally vertically within the cylinder head assembly 94 between the intake and exhaust valves 116, 140. The illustrated camshaft 154 is journaled for rotation by bearings formed at the cylinder head member 88.

The camshaft 154 has cam lobes to push cam follower portions of the rocker arms 156 in a timed manner, which is in proportion to the engine speed. The rocker arms 156 are journaled for pivotal movement by a rocker arm shaft 158 which is affixed to the bearings. Each actuating portion of the rocker arm 156 actuates the associated intake or exhaust valve 116, 140 between the open position and the closed position in response to the rotation of the camshaft 154.

With reference to FIG. 1, a camshaft drive mechanism preferably is provided for driving the valve drive mechanism. The camshaft drive mechanism is generally formed atop the engine body 104. The camshaft drive mechanism comprises a driven sprocket 162 positioned atop the camshaft 154, a drive sprocket 164 positioned atop the crankshaft 100 and a flexible transmitter, such as a timing belt or chain 166, for instance, wound around the driven sprocket 162 and the drive sprocket 164. The crankshaft 100 thus drives the camshaft 154 through the flexible transmitter in the timed relationship.

The engine 54 preferably comprises an ignition system (not shown). Each combustion chamber 90 is provided with a spark plug which preferably is disposed between the intake and exhaust valves 116, 140 and next to the camshaft 154. Each spark plug has electrodes that are exposed in the associated combustion chamber 90. The electrodes generate sparks in a timed manner to fire air/fuel charges formed within the combustion chambers 90. The air/fuel charges burn to generate power that moves the pistons 86 in a direction toward the crankshaft 100.

During the engine operation, heat builds in the engine body 104. The outboard motor 30 thus comprises a cooling water delivery system and preferably employs an open-loop type water delivery system that introduces cooling water as coolant from a body of water surrounding the outboard motor 30 and then discharges the water to the body of water.

With reference to FIGS. 6–13, the illustrated engine body 104 defines a water supply jacket 170, a water circulation jacket 172 and a water discharge jacket 174 as part of the water delivery system in the engine 54. The supply jacket 170 and the discharge jacket 174 are connected to water supply and discharge mechanisms defined within the housing unit 48 that are described in greater detail below with reference to FIGS. 1–7.

The supply and discharge jackets 170, 174 are defined at a portion of the cylinder block 82 next to the cylinder head member 88 on the port side with a cover plate 176 which is affixed to the cylinder block 82 with bolts 178. The supply and discharge jackets 170, 174 extend generally vertically and parallel to each other as best shown in FIG. 9.

Figure 10:
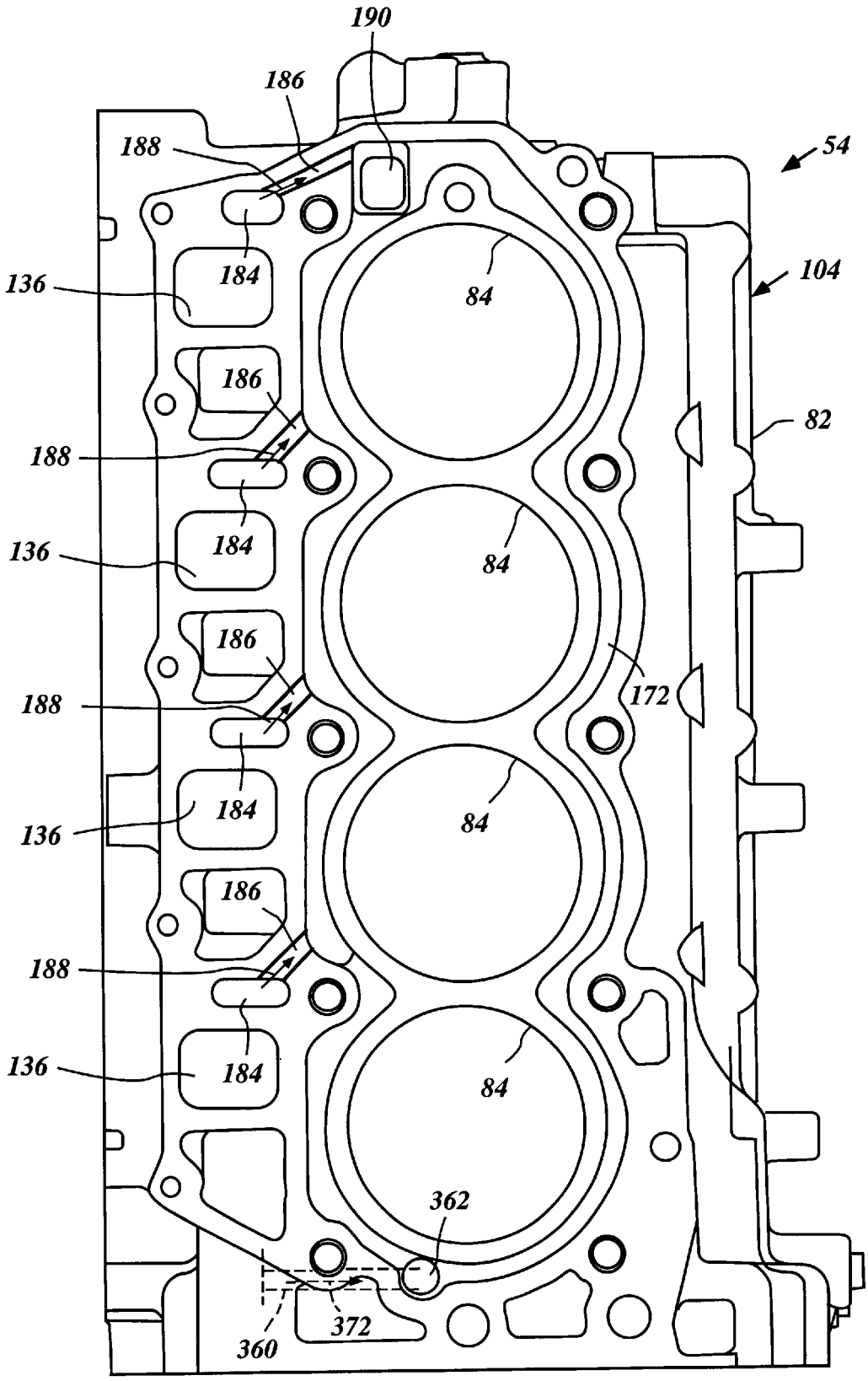
FIG. 10 is a rear elevational view of the cylinder block of FIG. 9 taken along the line 10—10 of FIG. 8.
Figure 11:
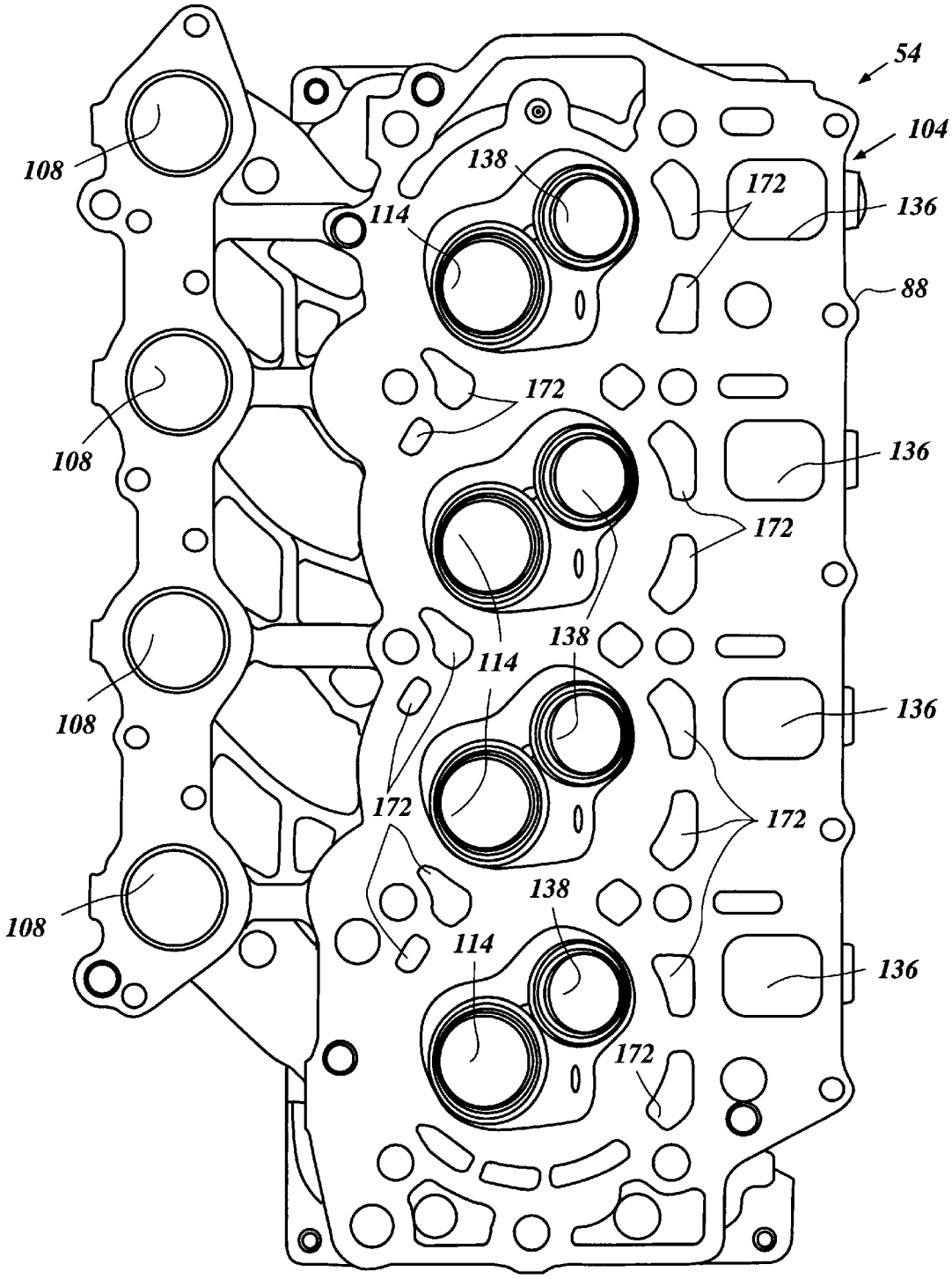
FIG. 11 is a front elevational view of a cylinder head member of the engine taken along the line 11—11 of FIG. 8.
Figure 13:
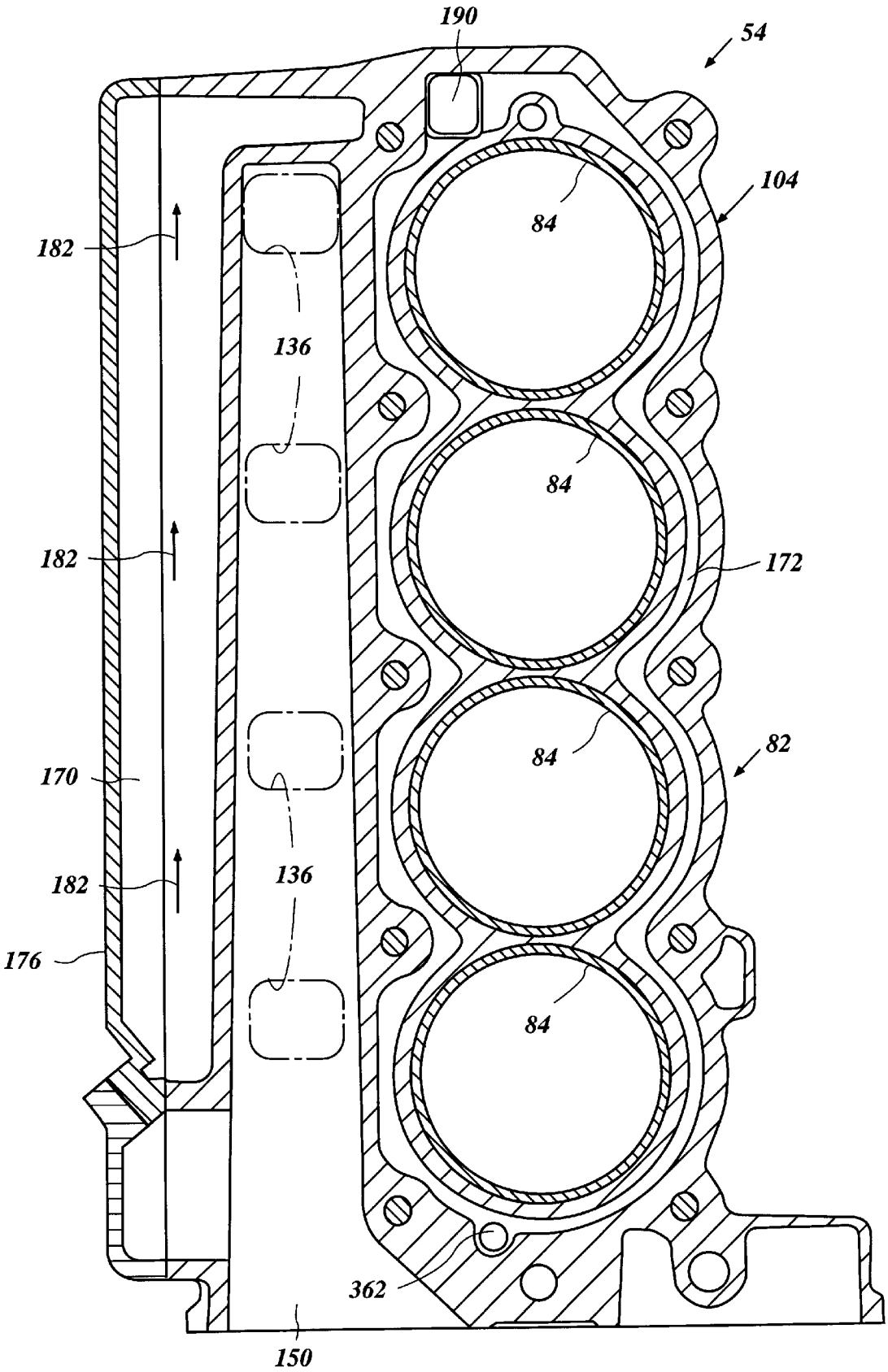
FIG. 13 is a sectional view of the cylinder block taken along the line 13—13 of FIG. 8.

The circulation jacket 172 comprises a cylinder block section and a cylinder head section. The cylinder block section generally surrounds the cylinder bores 84 as best shown in FIGS. 10 and 13, while the cylinder head section extends around the inner exhaust passages 136 and the combustion chambers 90 in the cylinder head member 88. Because of this arrangement, both the sections of the circulation jacket 172 and the supply jacket 170 together surround the inner exhaust passages 136 in the cylinder head member 88 and the cylinder block 82. Also, the supply jacket 170, the cylinder block section of the circulation jacket 172 and the discharge jacket 174 together surround the exhaust manifold 150.

Figure 9:
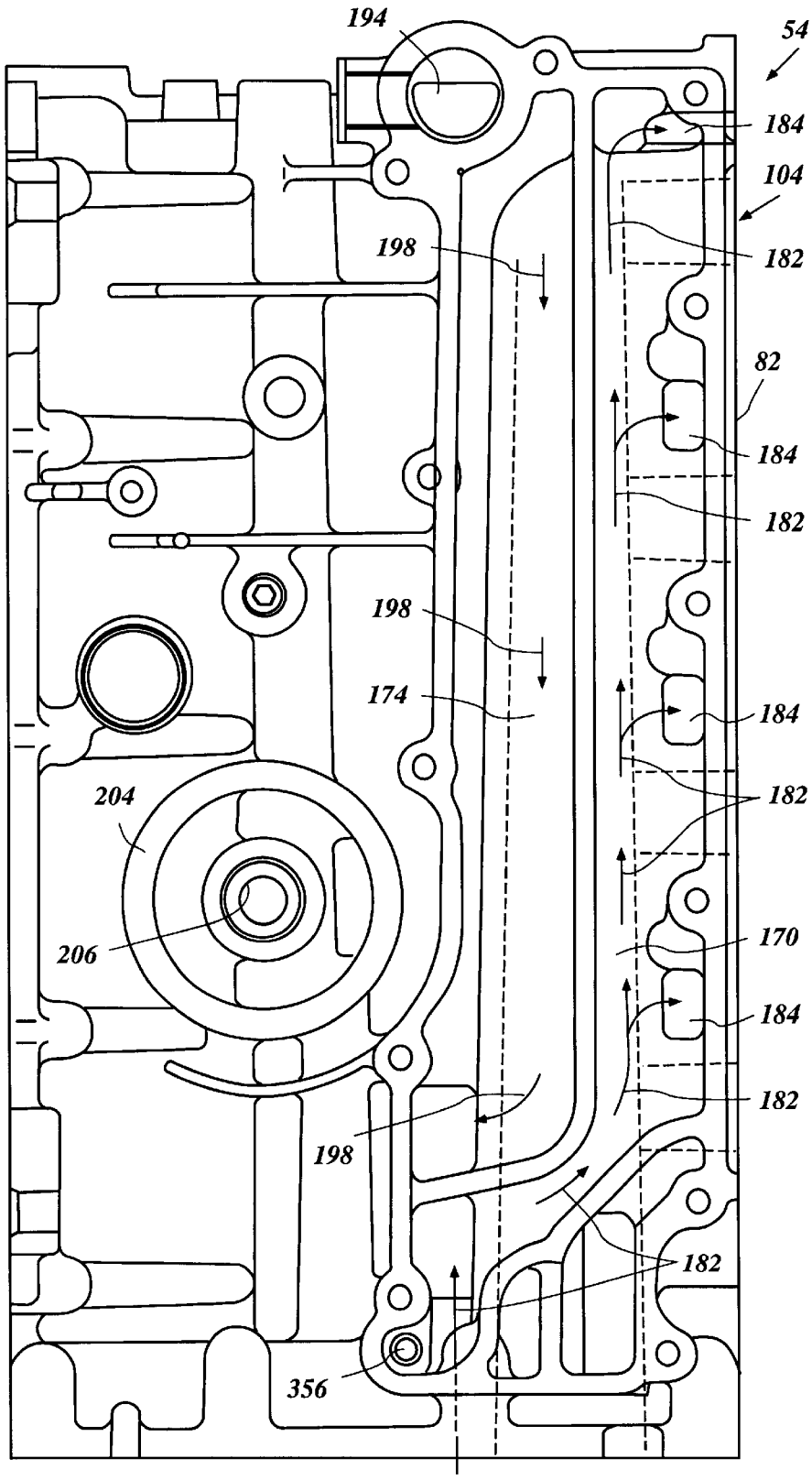
FIG. 9 is a side elevational view of a cylinder block of the engine on the port side taken along the line 9—9 of FIG. 8 with a water jacket cover member and an oil filter unit detached.
Figure 12:
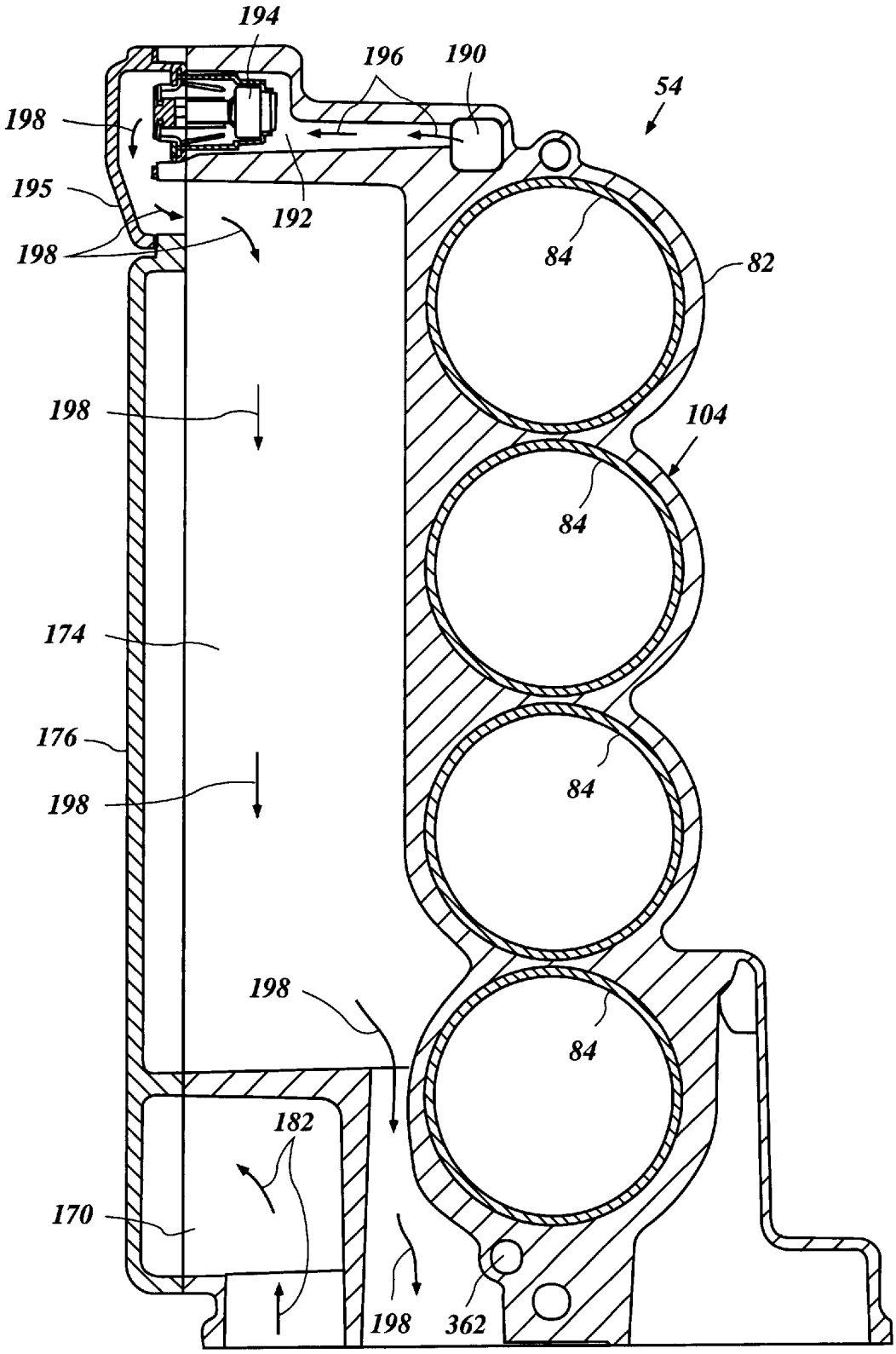
FIG. 12 is a sectional view of the cylinder block taken along the line 12—12 of FIG. 8.

During the operation, fresh and relatively cold water coming from the water supply mechanism in the housing unit 48 ascends through the supply jacket 170 as indicated by the arrows 182 of FIGS. 9, 12 and 13. The supply jacket 170 is branched off to water paths 184 (FIGS. 9 and 10) that are connected to the cylinder block section of the circulation jacket 172 by water paths 186 as indicated by the arrows 188 of FIG. 10. The water thus is supplied to the circulation jacket 172 and travels around the circulation jacket 172. Both the circulation and discharge jackets 172, 174 communicate with each other through a communication passage 190 (FIGS. 10, 12 and 13) formed atop the circulation jacket 172. The water goes from the circulation jacket 172 to the discharge jacket 174 through this passage 190.

A thermostat chamber 192 preferably is formed atop the discharge jacket 174 as shown in FIG. 12 and a thermostat 194 is disposed within the chamber 192. Preferably, a thermostat cover 195 is separately provided from the cover plate 176 and is affixed to the cylinder block 82 adjacent to the thermostat 194 to close the thermostat chamber 192. The thermostat cover 195 is convenient for maintenance of the thermostat 194. The water goes to the thermostat 194 as indicated by arrows 196 of FIG. 12. If the water is colder than a preset temperature at time, for example, immediately after the engine 54 has started and the engine has not been sufficiently warmed up, the thermostat 194 inhibits the water from going downstream thereof to expedite warming of the engine 54. Otherwise, the thermostat 194 permits the water to proceed downstream.

The water then goes down through the discharge jacket 174 to the water discharge mechanism of the housing unit 48 as indicated by arrows 198 of FIGS. 9 and 12. During the travel through the supply, circulation and discharge jackets 170, 172, 174, the water can absorb heat from the engine body 104.

With particular reference to FIGS. 1, 7, 8 and 9, the engine 54 preferably comprises a lubrication system. Although any type of lubrication systems can be applied, a closed-loop type of system is employed in the illustrated arrangement. Lubricant oil accumulates in a lubricant reservoir 200 described in greater detail below with additional reference to FIGS. 2 and 5–7.

The lubricant is supplied from the lubricant reservoir 200 to circulate through engine portions that need lubrication and then returns back to the reservoir 200. An oil filter unit 202 (FIGS. 1 and 8) preferably is affixed to a platform 204 (FIGS. 8 and 9) formed at a side surface next to the discharge jacket 174 of the water delivery system on the port side. The filter unit 202 communicates with internal lubricant passages within the engine body 104 through a lubricant path 206. The filter unit 202 includes at least one oil filter element to remove foreign matter (e.g., metal shavings, dirt, dust and water) from the lubricant oil before the lubricant circulating through the engine portions.

With reference to FIG. 1, a flywheel assembly 210 preferably is positioned atop the crankshaft 100 and is mounted for rotation with the crankshaft 100. The illustrated flywheel assembly 210 comprises a flywheel magneto or AC generator that supplies electric power to various electrical components such as the ignition system through a battery.

The driveshaft housing 50 is positioned below the exhaust guide member 74. With particular reference to FIGS. 1–6, a driveshaft 214 preferably extends generally vertically through an cylindrical opening 216 formed at forward portions of the engine body 104, the exhaust guide member 74 and the driveshaft housing 50 to be coupled with the crankshaft 100 at a bottom portion of the engine body 104. A shaft axis 218 of the driveshaft 214 generally extends through the center plane CP. The driveshaft 214 is journaled for rotation in the opening 216 and is driven by the crankshaft 100.

The driveshaft housing 50 encloses an exhaust conduit 218 (FIGS. 1 and 2) that conveys the exhaust gases to internal exhaust sections formed within the housing unit 48 from the exhaust passage 76 of the exhaust guide member 74. The internal exhaust sections includes an idle discharge section that is branched off from the exhaust passage 76 to discharge exhaust gases to the atmosphere under the idle operation of the engine 54.

A relatively small idle discharge port 220 preferably is opened at a rear upper portion of the driveshaft housing 50. An apron 222 covers an upper portion of the driveshaft housing 50 and improves the overall appearance of the outboard motor 30. The apron 222 has openings through which at least the exhaust discharge port 220 can communicate with the exterior of the apron 222.

Figure 7:
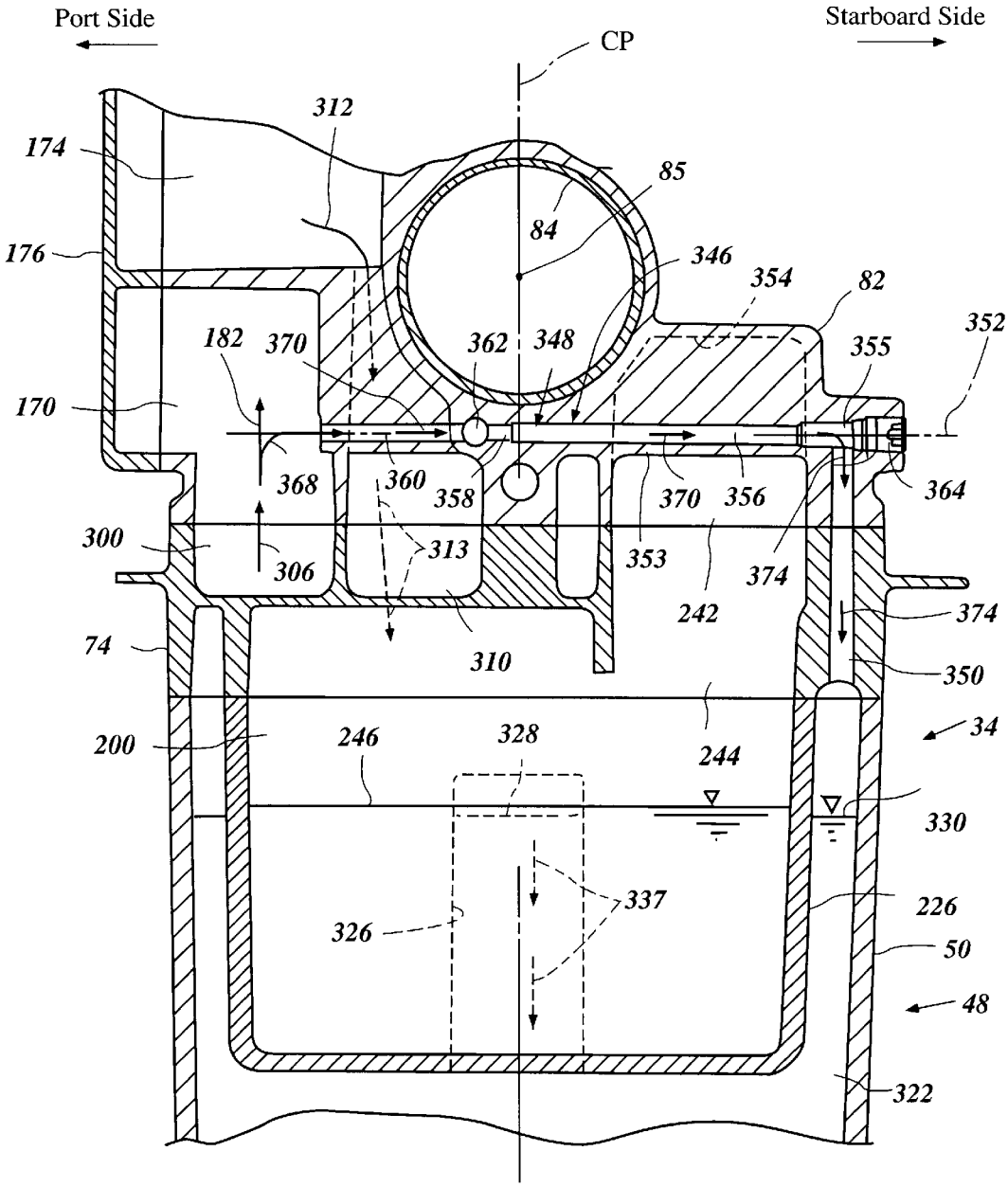
FIG. 7 is a sectional view of the outboard motor including a portion of the engine, the exhaust guide member and a portion of a housing unit. The section of the engine shown is taken along line 7—7 of FIG. 6.

With continued reference to FIGS. 1, 2, 5 and 6 and with additional reference to FIG. 7, a reservoir member 226 preferably depends from the exhaust guide member 74 within the driveshaft housing 50. The reservoir member 226 generally forms a donut shape recess that opens upwardly to define the lubricant reservoir 200. The reservoir member 226 also defines a reversed recess that opens downwardly at a center of the donut shape recess. The center portion of the reservoir member 226 is affixed to a bottom surface of the exhaust guide member 74 by bolts 228 (FIG. 1).

The exhaust conduit 218 extends through the downward recess and has a flange that is affixed to the center portion of the reservoir member 226 in common with the reservoir member 226 by some of the bolts 228. The center portion of the reservoir member 226 defines an exhaust path 230 (FIG. 1) through which the exhaust passage 76 of the exhaust guide member 74 communicates with the exhaust conduit 218. The reservoir member 226 surrounds the exhaust conduit 218 with a certain distance. A space 232 thus is formed between an inner surface of the downward recess and an outer surface of the exhaust conduit 218.

A suction pipe 236 extends from a bottom portion of the lubricant reservoir 200 upwardly toward the part of the lubrication system within the engine body 104. An oil filter 238 is attached to remove foreign substances from the lubricant oil before passing through the suction pipe 236. An oil pump (not shown) preferably is coupled with the driveshaft 214 or the crankshaft 100 to pressurize and thereby circulate the lubricant from the section pipe 236 to the engine portions. As described above, the lubricant delivered to the engine 54 circulates within the engine body 104 to lubricate the engine portions such as, for example, the crankshaft 100, the camshaft 154, the rocker arms 156 and the pistons 86.

The lubricant that has lubricated the engine portions falls to the bottom of the cylinder block 82 by its own weight. With reference to FIG. 6, the cylinder block 82 defines a plurality of lubricant return passages 242. The return passages 242 preferably open relatively large and are generally located along a side surface of the cylinder block 82 on the starboard side and a rear surface thereof. The major part of the passages 242, however, are positioned on the starboard side, opposite the exhaust manifold 150 relative to the center plane CP.

With reference to FIGS. 4, 5 and 7, the exhaust guide member 74 also defines lubricant return passages 244 that communicates with the lubricant reservoir 200. The exhaust guide member 74 forms a top closure member of the lubricant reservoir 200 except for the return passages 244. The lubricant oil thus returns to the lubricant reservoir 200 through the return passages 242 of the cylinder block 82 and the return passages 244 of the exhaust guide member 74. FIGS. 6 and 7 schematically illustrates a level 246 of the lubricant oil within the reservoir 200.

Figure 2:
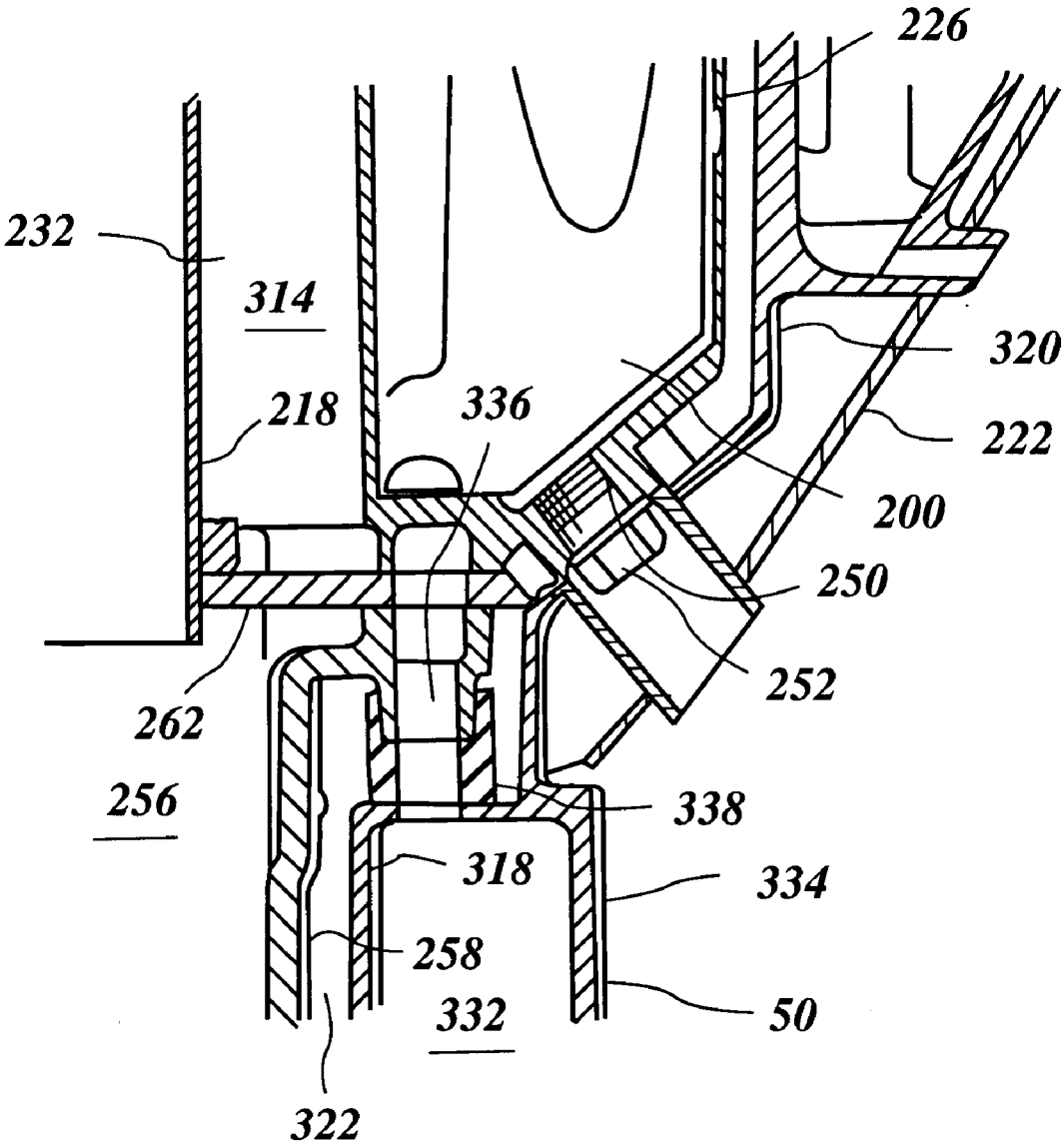
FIG. 2 is an enlarged side view of a portion of the outboard motor encircled by a phantom line 2 of FIG. 1.
Figure 3:
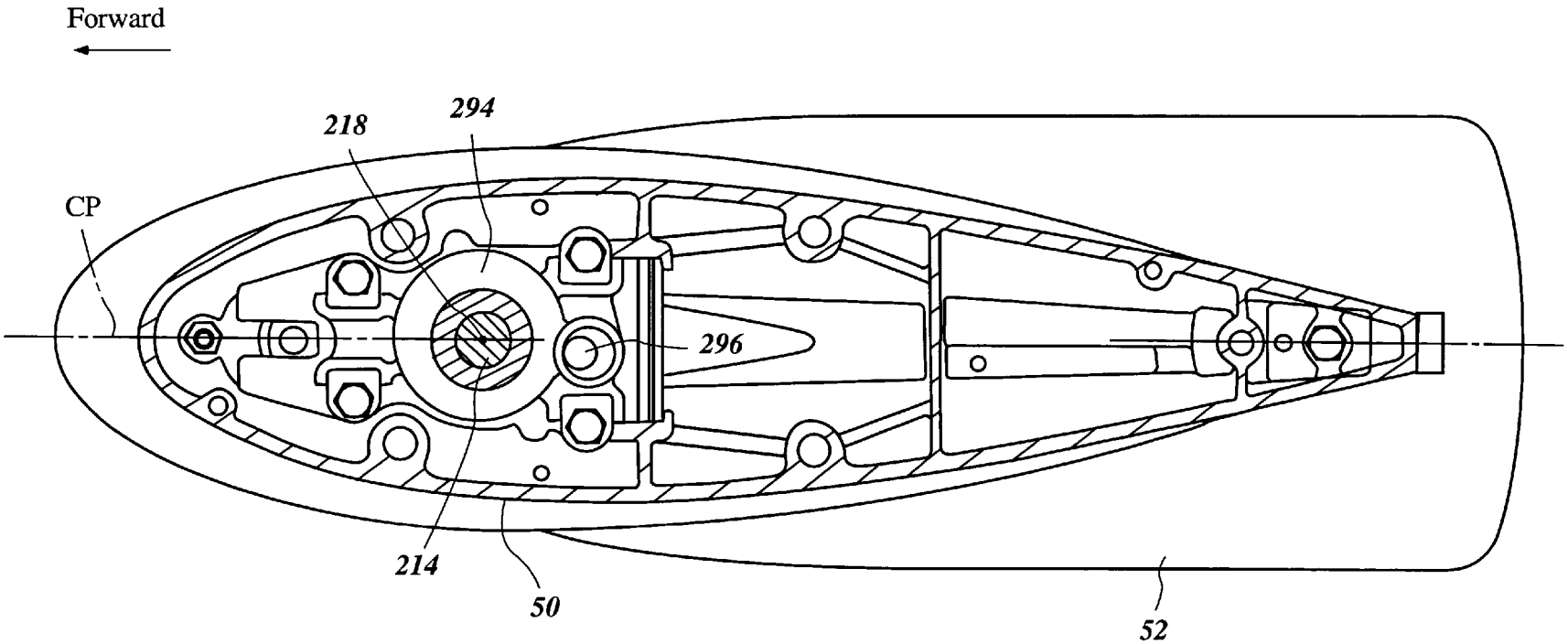
FIG. 3 is a sectional view of the outboard motor taken along the line 3—3 of FIG. 1.

With reference to FIG. 2, a drain hole 250 is defined at a bottom of the reservoir member 226 to drain the lubricant in the reservoir 200 to a location out of the outboard motor 30. Normally, a closure bolt 252 is fitted into the drain hole 250 to close the hole 250.

With particular reference to FIG. 1, a first expansion chamber 256 preferably is defined below the exhaust conduit 218 in the driveshaft housing 50. In the illustrated arrangement, a jar-shaped member 258 depends from a bottom of the reservoir member 226 to form the first expansion chamber 256 therein. The jar shaped member 258 has a top opening which is larger than an outer diameter of the exhaust conduit 218 and a lowermost portion of the exhaust conduit 218 extends into the expansion chamber 256. The top portion of the jar shaped member 258 is provided with a flange and the jar shaped member 258 is affixed to the bottom of the reservoir 226 with the flange by bolts 260. The jar shaped member 258 tapers off in girth toward a bottom thereof and is seated on a pedestal formed at an inner bottom portion of the driveshaft housing 50 via a seal member 261. The bottom of the jar shaped member 258 defines an opening that opens toward the lower unit 52.

Preferably, a partition 262 (FIGS. 1 and 2) generally separates the first expansion chamber 256 from the space 232 defined above the chamber 256. The partition 262 is affixed to the bottom of the reservoir member 226 together with the flange of the jar-shaped member 258. The exhaust conduit 218 is provided with a flange that abuts against the partition 262. A seal member is interposed between the flange and the partition 262 to inhibit exhaust gases from moving to the space 232 from the first expansion chamber 256. The partition 262 defines an aperture and the exhaust conduit 218 passes through the aperture to the expansion chamber 256. The partition 262 also defines one or more holes (not shown) through which the first expansion chamber 256 communicates with the space 232.

With continued reference to FIG. 1, the lower unit 52 depends from the driveshaft housing 50 and supports a propulsion shaft 266, which is driven by the driveshaft 214. The propulsion shaft 266 extends generally horizontally through the lower unit 52. A propulsion device 268 is attached to the propulsion shaft 266 to be driven by the propulsion shaft 266. In the illustrated arrangement, the propulsion device 268 includes a propeller 270 affixed to an outer end of the propulsion shaft 266. More specifically, a hub 272 of the propeller 270 is mounted on the propulsion shaft 266 with a rubber damper 273. The propulsion device 268, however, can take the form of a dual counter-rotating system, a hydrodynamic jet, or any of a number of other suitable propulsion devices.

A transmission 276 preferably is provided between the driveshaft 214 and the propulsion shaft 266. The transmission 276 couples together the two shafts 214, 266 which lie generally normal to each other (i.e., at a 90° shaft angle) with bevel gears. The outboard motor 30 has a clutch mechanism that allows the transmission 276 to change the rotational direction of the propeller 270 among forward, neutral or reverse.

The lower unit 52 also defines an internal passage of the exhaust system. A second expansion chamber 280 defines a major volume of the passage and is formed above a space where the propulsion shaft 266 extends. The second expansion chamber 280 is tapered off downwardly like the first expansion chamber 256. The second expansion chamber 280 communicates with the first expansion chamber 256 and with a discharge passage 282 defined at the hub 272 of the propeller 270.

At engine speeds above idle, the exhaust gases coming from the engine 54 pass through the exhaust passage 76 of the exhaust guide member 74, the exhaust conduit 218, the first and second expansion chambers 256, 280 and then exit to the body of water through the discharge passage 282 of the propeller 270. Because the gases expand and contract twice within the first and second expansion chambers 256, 280, exhaust noise is attenuated.

At idle speed, the exhaust gases flow to the idle exhaust section and are discharged through the idle discharge port 220. The difference in the locations of the discharges accounts for the differences in pressure at locations above the waterline and below the waterline. Because the opening above the waterline, i.e., the idle discharge port 220, is smaller, pressure develops within the lower unit 52. When the pressure exceeds the higher pressure found below the waterline, the exhaust gases exit through the hub 271 of the propeller 270. If the pressure remains below the pressure found below the waterline, the exhaust gases exit through the idle discharge section above the waterline.

With reference to FIGS. 1–7, part of the cooling water delivery system in the exhaust guide member 74 and the housing unit 48 is described below.

The lower unit 52 preferably forms a water inlet 290 at a side surface on the port side. Alternatively, two water inlets can be formed on both sides. A water delivery passage 292 is defined within the lower unit 52 and extends generally vertically along the driveshaft 214 from the water inlet 290 toward the bottom of the driveshaft housing 50.

A water pump 294 is mounted on the driveshaft 214 at the bottom of the driveshaft housing 50 to be driven thereby and the water passage 292 is connected to the water pump 294. A water delivery conduit 296 extends generally vertically along the driveshaft 214 from the water pump 294 to a water delivery port 298 (FIGS. 4 and 5) defined at the bottom of the exhaust guide member 74.

The water delivery port 298 communicates with a water delivery passage 300 (FIG. 5) that is formed within the exhaust guide member 74 and communicates with the water supply jacket 170 of the cylinder block 82. The water delivery passage 300 extends generally along a side surface of the exhaust guide member 74 on the port side and generally opposite to the lubricant return passages 244. Further, a rearmost portion of the water delivery passage 300 is formed in the close vicinity of the exhaust passage 76.

Cooling water is taken from the body of water and is drawn through the water inlet 290 with the water pump 294 driven by the driveshaft 214. The water pump 294 pressurizes and thereby moves the water from the water inlet 290 to the water delivery port 298 of the exhaust guide member 74 through the water delivery passage 292, the water delivery conduit 296 as indicated by the arrows 304 of FIG. 1. The water then flows to the water supply jacket 170 of the cylinder block 82 through the water delivery passage 300 as indicated by the arrows 306 of FIGS. 5 and 7.

The exhaust guide member 74 also defines a water discharge passage 310 (FIGS. 4, 5 and 7) communicating with the water discharge jacket 174 of the cylinder block 82. The water discharge passage 310 extends close to the exhaust passage 76. At least a portion of the illustrated discharge passage 310 is interposed between the exhaust passage 76 and the lubricant return passages 244. The water in the discharge jacket 174 moves to the water discharge passage 310 as indicated by the arrow 312 of FIG. 7.

The water passage 310 of the exhaust guide member 74 also communicates with the space 232 defined by the reservoir member 226 and the exhaust conduit 218. The water in the discharge passage 310 moves to the space 232 through the discharge passage 310 as indicated by the arrows 313 of FIG. 7. Because the partition 262 generally separates the space 232 from the first expansion chamber 256, the water can temporarily accumulate within the space 232. The space 232 thus defines a first water pool 314. Because the partition 262 has the holes, the water can gradually move to the first expansion chamber 256 through the holes. The water then moves down through the first and second expansion chambers 256, 280 and goes out to the body of water through the discharge passage 282 of the propeller hub 272 with the exhaust gases.

With particular reference to FIGS. 1 and 2, the driveshaft housing 50 preferably defines an internal wall 318 that surrounds the jar shaped member 258. The internal wall 318 merges an outer wall portion 320 of the driveshaft housing 50 that generally surrounds the reservoir member 226. The internal wall 318 and the wall portion 320 together form a second water pool 322 around the first expansion chamber 256 and the reservoir member 226.

With particular reference to FIGS. 1, 2 and 7, the reservoir member 226 defines a water discharge path 326 at a side surface on the starboard side. The water discharge path 326 extends generally vertically. The discharge path 326 defines a spillway 328 atop thereof to regulate a water level 330 in the second water pool 322. The water discharge path 326 communicates with a water discharge guide 332 formed between the internal wall 318 and the outer wall portion 320 of the driveshaft housing 56 through apertures (not shown) defined at the partition 262 and a connecting passage 336. Spilled water thus moves to the water discharge guide 332 through the discharge path 326, the apertures and the connecting passage 336 as indicated by the arrows 313 of FIG. 7. A lower portion of the connecting passage 336 preferably is formed with a rubber tube 338.

At almost the bottom of the water discharge guide 332, the lower unit 52 defines several slots 342 on both side surfaces and the water discharge guide 332 communicates with a location outside of the housing unit 48. Alternatively, either the side surface on the port side or the starboard side may define the slots 342. The water thus is discharged outside through the slots 342.

With particular reference to FIGS. 6 and 7, a water delivery passage 346 preferably delivers fresh and relatively cold water to the second water pool 322. In the illustrated arrangement, the cylinder block 82 defines the delivery passage 346, which is branched off from the water supply jacket 170. Alternatively, for example, the delivery passage 346 can be formed within the exhaust guide member 74.

The illustrated delivery passage 346 includes a first passage section 348 and a second passage section 350. The first passage section 348 extends transversely between the lowermost cylinder bore 84 and the lubricant reservoir 200 from the water supply jacket 170 to a portion next to a side surface on the starboard side. The first passage section 348 has a passage axis 352 extending generally parallel to the tilt axis 43 and normal to the steering shaft axis, the cylinder bore axes 85 and the shaft axis 218 of the driveshaft 214. The illustrated passage axis 352 extends straight in a side view as shown in FIG. 7. However, the first passage Section 348 is divided into two portions, which are slightly offset from each other in a plan view as shown in FIG. 6.

The second passage section 350 generally extends vertically from an end portion of the first passage section 348 defined at the cylinder block 82 to the second water pool 322 aside the lubricant reservoir 200 on the starboard side. In other words, the second passage section 350 extends through the cylinder block 82, the exhaust guide member 74 and the driveshaft housing 50 along a side surface on the starboard side.

The water delivery passage 346 can be formed in any one of conventional manners. In connection with the illustrated delivery passage 346, the first passage section 348 is formed in a drilling manner and the second passage section 350 is formed during a casting process of the cylinder block 82, the exhaust guide member 74 and the driveshaft housing 50.

The illustrated cylinder block 82 forms a bridge portion 353 at the lubricant return passage 242. The bridge portion 353 preferably extends from a top end 354 of the lubricant return passage 242 and transverses the return passage 242.

The illustrated first passage section 348 comprises four portions, i.e., a large diameter portion 355, a first middle diameter portion 356, a small diameter portion 358 and a second middle diameter portion 360 which are arranged in this order from the side surface on the starboard side. All the portions 355, 356, 358, 360 have circular shapes in section. At the large diameter portion 355, the first passage section 348 is connected to the second passage section 350. The first middle diameter portion 356 passes through the bridge portion 353.

In the illustrated arrangement, with particular reference to FIG. 6, an axis 361 of the second middle diameter portion 360 is slightly offset from the axis 352 of the small diameter portion 356, the first middle diameter portion 356 and the large diameter portion 355 as generally noted above. Because the axis 361 can completely be coincident with the axis 352, the axis 352 represents the passage axis of the first passage section 348 in the context of this description.

An opening 362 is previously formed in a casting process of the cylinder block 82 that can communicate with both the circulation jacket 172 and with the first passage section 348 when the first passage section 348 is made. Also, the cylinder block 82 previously defines an opening of the second passage section 350 in the same casting process of the cylinder block 82 that can communicate with the first passage section 348 when the first passage section 348 is made.

The large diameter portion 355, the first middle diameter portion 356 and the small diameter portion 358 preferably are bored with a drill having three diameters, the smallest one being positioned at a tip portion thereof. The drill bores the large, the first middle and small diameter portions 355, 356, 358 from a side surface on the starboard side with the tip portion reaching the opening 362. Because the small diameter portion 358 is formed at the opening 362, the boring process of the small diameter portion 358 is quite easy and manufacturing cost can be greatly saved. After boring, a threaded plug 364 closes an end of the large diameter portion 355 at the side surface on the starboard side.

The second middle diameter portion 356 preferably is bored with another drill from a side surface on the port side. Because this side surface is not covered when the cover plate 176 is removed, the drill can access the cylinder block 82 on this side. A hole bored by the drill reaches the opening 362 to form the second middle diameter portion 360. The delivery passage 346 thus is completed with the drilled first passage section 348 and the second passage section 350 that is made in the casting process. After the completion, the small diameter portion 358 defines a narrowed portion intermediately existing between two portions, i.e., the first and second middle diameter portions 356, 360.

With particular reference to FIGS. 6 and 7, some of the water in the supply jacket 170 moves into the second middle diameter portion 360 of the first passage section 348 as indicated by the arrow 368 of FIGS. 6 and 7. The water then flows to the first middle diameter portion 356 through the small diameter portion 348, i.e., the narrowed portion as indicated by the arrows 370 of FIGS. 6 and 7. In the illustrated arrangement, some of the water can move to the circulation jacket 172 through the opening 362 before entering the narrowed portion 358 as indicated by the arrow 372 of FIG. 6 and additionally by the arrow 372 of FIG. 10. The water proceeding through the first passage section 348 flows to the second water pool 322 through the second passage section 350 as indicated by the arrows 374 of FIG. 7. Thus, the fresh and relatively cold water is delivered to the second water pool 322.

During travel the delivery passage 346, the water removes heat therefrom and specifically from the lubricant that passes through the return passages 242, 244 and the lubricant reservoir 200, the outer surfaces of the cylinder block 82, the exhaust guide member 74, and the driveshaft housing 50 on the starboard side. In addition, because the second water pool 322 is provided with the fresh and cold water, the lubricant reservoir 200 and the first expansion chamber 256 can be further cooled.

Because of being narrowed at the small diameter portion 358, the first passage section 348 only allows a limited amount of the cold water to proceed to the middle diameter portion 356. This is advantageous because the portion of the delivery passage 346 located downstream of the narrowed portion 358 does not excessively cool the portion of the cylinder block 82, the exhaust guide member 74, and the housing unit 48 around the delivery passage portion. An inner diameter of the narrowed portion 358 can be properly selected in accordance with a size, configuration and other conditions of the components 82, 74, 48. An exemplary narrowed portion 358 has the inner diameter of four millimeters. In general, foreign matters such as, for example, salt are apt to deposit at such a narrowed portion. However, the water flows through the narrowed portion 358 in a speed higher than in other portions 360, 356. The higher speed of the water can make a dynamic pressure. Accordingly, the foreign matter (e.g., salt) can be removed and is less likely to deposit at the narrowed portion 358. In addition, because a diameter of a water drop is usually three or four millimeters, the diameter of the narrowed portion 358 is generally equal to or greater than the diameter of the water drop. The size of the narrowed portion 358 is advantageous because any water drops, if any, do not stay in the narrowed portion 358 while the engine 54 does not operate. No foreign matter such as salt that can be contained in the water drops will deposit in the narrowed portion 358.

Usually, the drive unit 34 is placed in a fully tilted up position when the outboard motor 30 is out of use but is still mounted on the transom of the associated watercraft 37. Because of the pivotal movement about the steering axis, the drive unit 34 tends to incline toward either the port side or the starboard side. Without the water delivery passage 346, the water that remains in the jackets, passages or paths might not find a way to move out from the drive unit 34 under a condition such that the drive unit 34 inclines toward the starboard side (thus, the port side half is higher than the starboard side half) and might be trapped within the jackets, passages or paths. However, the water delivery passage 346 can provide the water with the way to move out under any positions of the drive unit 34. Thus, water is less likely to stay in the jackets, passages or paths in the illustrated arrangement in any inclined positions of the drive unit, accordingly.

Of course, the foregoing description is that of a preferred construction having certain features, aspects and advantages in accordance with the present invention. For instance, the water delivery passage can be formed within the exhaust guide member 74. The bridge portion 353 does not necessarily extend from the top end of the lubricant return passage 242 and a space can be made between a portion in which the middle diameter portion extends and the top end. Accordingly, various changes and modifications may be made to the above-described arrangements without departing from the spirit and scope of the invention, as defined by the appended claims.

What is claimed is:

1. An outboard motor comprising a housing unit adapted to be mounted on an associated watercraft, an internal combustion engine defining a first exhaust passage and a first lubricant passage, the first exhaust passage generally extending on a first side of the outboard motor, the first lubricant passage generally extending on a second side of the outboard motor opposite to the first side, a support member coupled with the housing unit to support the engine above the housing unit, an exhaust conduit depending from the support member within the housing unit, the support member defining a second exhaust passage connecting the exhaust conduit with the first exhaust passage, the second exhaust passage generally extending on the first side, and a lubricant reservoir depending from the support member within the housing unit, the support member defining a second lubricant passage connecting the lubricant reservoir with the first lubricant passage, the second lubricant passage generally extending on the second side, the engine and the support member together defining a first coolant passage extending in the vicinity of the first and second exhaust passages, either the engine or the support member defining a second coolant passage extending from the first coolant passage toward a location in the vicinity of either the first or second lubricant passage.

2. The outboard motor as set forth in claim 1, wherein the engine and the support member together or the support member solely defines a third coolant passage connected to the second coolant passage, the third coolant passage generally extending aside the lubricant reservoir on the second side.

3. The engine as set forth in claim 1, wherein at least the housing unit defines a coolant pool around the lubricant reservoir, the engine and the support member together or the support member solely defining a third coolant passage connecting the second coolant passage to the coolant pool.

4. The outboard motor as set forth in claim 3, wherein the third coolant passage generally extends aside the lubricant reservoir on the second side.

5. The outboard motor as set forth in claim 1, wherein the second coolant passage includes at least one narrowed portion formed narrower than the rest of the second coolant passage.

6. The outboard motor as set forth in claim 5, wherein an inner diameter of the narrowed portion is generally larger than a size of a water drop.

7. The outboard motor as set forth in claim 5, wherein an inner diameter of the narrowed portion is generally equal to or larger than four millimeters.

8. The outboard motor as set forth in claim 1, wherein either the first or second lubricant passage generally surrounds a portion of the second coolant passage.

9. The outboard motor as set forth in claim 8, wherein either the engine or the support member defines a bridge portion crossing either the first or second lubricant return passage, and the second coolant passage at least in part extending through the bridge portion.

10. The outboard motor as set forth in claim 1, wherein the second coolant passage extends generally straight.

11. The outboard motor as set forth in claim 1, wherein the second coolant passage extends generally transversely to the outboard motor.

12. The outboard motor as set forth in claim 1 additionally comprising a bracket assembly arranged to carry the housing unit for tilt movement about a tilt axis generally horizontally extending, the second coolant passage generally extending parallel to the tilt axis, wherein the bracket assembly is additionally configured to carry the housing unit for steering movement about a steering axis generally vertically extending, and the second coolant passage generally extending normal to the steering axis.

13. An outboard motor comprising a bracket assembly adapted to be mounted on an associated watercraft, and a drive unit supported by the bracket assembly for tilt movement about a generally horizontally extending tilt axis and for steering movement about a generally vertically extending steering axis, the drive unit comprising an internal combustion engine disposed atop thereof, an exhaust system arranged to discharge exhaust gases from the engine, the exhaust system at least in part generally disposed on a first side of the drive unit, and a coolant delivery system arranged to cool either the engine or the exhaust system, the coolant delivery system at least in part generally disposed on the first side of the drive unit, the coolant delivery system including a coolant passage extending toward a second side of the drive unit opposite to the first side, and the coolant passage extending generally horizontally and parallel to the tilt axis.

14. The outboard motor as set forth in claim 13, wherein the coolant passage extends generally normal to the steering axis.

15. The outboard motor as set forth in claim 13, wherein the coolant passage extends generally straight.

16. The outboard motor as set forth in claim 13 additionally comprising a lubrication system arranged to lubricate the engine, the lubrication system including a lubricant reservoir disposed below the engine, and a lubricant passage extending between the engine and the lubricant reservoir, the lubricant passage at least in part intersecting the coolant passage.

17. The outboard motor as set forth in claim 16, wherein the drive unit defines a bridge portion crossing the lubricant passage, the coolant passage extending through the bridge portion.

18. The outboard motor as set forth in claim 13 additionally comprising a lubrication system arranged to lubricate the engine, the lubrication system including a lubricant reservoir, the coolant delivery system including a coolant pool formed around lubricant reservoir, and the coolant passage extending to the coolant pool.

19. The outboard motor as set forth in claim 13 additionally comprising a lubrication system arranged to lubricate the engine, the lubrication system including a lubricant reservoir disposed below the engine, the engine including at least one cylinder, the coolant passage extending between the cylinder and the lubricant reservoir.

20. The outboard motor as set forth in claim 13, wherein the coolant passage includes a portion formed narrower than the rest of the coolant passage.

21. An outboard motor comprising a bracket assembly adapted to be mounted on an associated watercraft, and a drive unit supported by the bracket assembly, the drive unit comprising an internal combustion engine disposed atop thereof, the engine including at least one cylinder having a generally horizontally extending axis, an exhaust system arranged to discharge exhaust gases from the engine, the exhaust system at least in part generally disposed on a first side of the drive unit, and a coolant delivery system arranged to cool either the engine or the exhaust system, the coolant delivery system at least in part generally disposed on the first side of the drive unit, the coolant delivery system including a coolant passage extending to a second side of the drive unit opposite to the first side, and the coolant passage extending generally horizontally and normal to the axis of the cylinder.

22. The outboard motor as set forth in claim 21, wherein the coolant passage extends generally straight.

23. The outboard motor as set forth in claim 21 additionally comprising a lubrication system arranged to lubricate the engine, the lubrication system including a lubricant reservoir disposed below the engine, and a lubricant return passage extending between the engine and the lubricant reservoir, the lubricant return passage at least in part intersecting the coolant passage.

24. The outboard motor as set forth in claim 21 additionally comprising a lubrication system arranged to lubricate the engine, the lubrication system including a lubricant reservoir disposed below the engine, the coolant delivery system including a coolant pool formed around lubricant reservoir, the coolant passage extending to the coolant pool.

25. The outboard motor as set forth in claim 21, wherein the coolant passage includes a portion formed narrower than the rest of the coolant passage.

* * * * *